US011440568B2

(12) United States Patent
Todt et al.

(10) Patent No.: US 11,440,568 B2
(45) Date of Patent: Sep. 13, 2022

(54) RAILWAY VEHICLE COUPLER

(71) Applicant: Amsted Rail Company, Inc., Chicago, IL (US)

(72) Inventors: Matthew Todt, Highland, IL (US); Timothy Dumey, Troy, IL (US)

(73) Assignee: Amsted Rail Company, Inc., Chicago, IL (US)

( * ) Notice: Subject to any disclaimer, the term of this patent is extended or adjusted under 35 U.S.C. 154(b) by 411 days.

(21) Appl. No.: 16/716,564

(22) Filed: Dec. 17, 2019

(65) Prior Publication Data

US 2020/0198670 A1 Jun. 25, 2020

Related U.S. Application Data

(60) Provisional application No. 62/783,423, filed on Dec. 21, 2018.

(51) Int. Cl.
*B61G 3/06* (2006.01)

(52) U.S. Cl.
CPC ..... *B61G 3/06* (2013.01)

(58) Field of Classification Search
CPC ... B61G 3/02; B61G 3/04; B61G 3/06; B61G 3/08; B61G 3/22; B61G 3/24
See application file for complete search history.

(56) References Cited

U.S. PATENT DOCUMENTS

| | | | | |
|---|---|---|---|---|
| 4,090,615 | A | 5/1978 | Martin | |
| 4,605,133 | A | 8/1986 | Altherr | |
| 5,582,307 | A | 12/1996 | Hawthorne | |
| 9,038,836 | B1 | 5/2015 | Tavares | |
| 9,707,980 | B2 | 7/2017 | Mautino | |
| 2012/0037586 | A1 | 2/2012 | Dumey | |
| 2012/0292282 | A1 | 11/2012 | Nibouar | |
| 2016/0288806 | A1 * | 10/2016 | Manibharathi | B61G 3/06 |

OTHER PUBLICATIONS

International Search Report and Written Opinion for PCT/US2019/066688, dated Apr. 22, 2020.

* cited by examiner

*Primary Examiner* — Robert J McCarry, Jr.
(74) *Attorney, Agent, or Firm* — The Small Patent Law Group LLC; Joseph M. Butscher

(57) ABSTRACT

A knuckle of a coupler of a rail vehicle includes a leading beam having a pulling face, a lateral offset beam extending from the leading beam, a tail extending from the lateral offset beam, an extension wall extending from the lateral offset beam towards an end of the tail, and a tapered lock engagement wall extending from the extension wall to the end of the tail. The tapered lock engagement wall is angled in relation to the extension wall. The tapered lock engagement wall is configured to engage an interior face of a main body of a lock of the coupler. The interior face defines a knuckle-engaging surface that is configured to bear against the tapered lock engagement wall.

20 Claims, 5 Drawing Sheets

RAILWAY VEHICLE COUPLER

RELATED APPLICATIONS

This application relates to and claims priority benefits from U.S. Provisional Patent Application No. 62/783,423, filed Dec. 21, 2018, which is hereby incorporated by reference in its entirety.

FIELD OF THE DISCLOSURE

Embodiments of the present disclosure generally relate to couplers for rail vehicles, such as rail cars, and, more particularly, to knuckles of couplers for rail vehicles.

BACKGROUND OF THE DISCLOSURE

Rail vehicles travel along railways, which have tracks that include rails. A rail vehicle includes one or more truck assemblies that support one or more car bodies.

Rail vehicles typically have couplers located at opposite ends to facilitate connection with the end of another rail vehicle of a train. The portions of each coupler that engage or contact one another are referred to as knuckles. Examples of coupler knuckles are described in U.S. Pat. Nos. 4,605,133, 4,090,615, and 5,582,307.

As knuckles of adjoining couplers experience draft loads (that is, pulling forces), the draft loads can generate a longitudinal reaction force at a pulling lug of the knuckle. In certain couplers, the contour or shape of the knuckle is such that a pulling face is located off center from corresponding features of the pulling lug. The offset pulling face can generate a lateral reaction force at the pulling lug. Consequently, the knuckle may rotate until contact occurs with a lock of the coupler.

Typically, during draft loading, a wall of the knuckle contacts the lock at a single point at the rear end. Lateral reaction forces for knuckles can be relatively high because a moment arm extends fully to the rear end of the knuckle. The resulting force can increase stress through the tail of the knuckle, which can ultimately lead to undesirable levels of fatigue, damage, and even potential knuckle failure.

SUMMARY OF THE DISCLOSURE

A need exists for a knuckle of a coupler of a rail vehicle that is less susceptible to fatigue, damage, or failure. Moreover, a need exists for a knuckle that is cost-effective to manufacture.

With those needs in mind, certain embodiments of the present disclosure provide a knuckle of a coupler of a rail vehicle. The knuckle includes a leading beam having a pulling face, a lateral offset beam extending from the leading beam, a tail extending from the lateral offset beam, an extension wall extending from the lateral offset beam towards an end of the tail, and a tapered lock engagement wall extending from the extension wall to the end of the tail. The tapered lock engagement wall is angled in relation to the extension wall. The tapered lock engagement wall is configured to engage an interior face of a main body of a lock of the coupler. The interior face defines a knuckle-engaging surface that is configured to bear against the tapered lock engagement wall.

The tapered lock engagement wall angles inwardly towards a central longitudinal plane of the tail. In at least one embodiment, the tapered lock engagement wall includes a front edge that connects to a rear edge through a flat surface.

The rear edge is closer to a central longitudinal plane of the tail than the front edge. The tapered lock engagement wall is out of plane in relation to a lateral surface of the extension wall.

The tapered lock engagement wall is at an angle θ in relation to a lateral surface of the extension wall. The angle θ is not 180 degrees. In at least one embodiment, the angle θ is between 1 degree and 10 degrees. For example, the angle θ is at least 2 degrees. In at least one embodiment, the angle θ is 3 degrees.

In at least one embodiment, the tapered lock engagement wall is configured to bear against an entirety of the interior face of the lock during draft load application.

The knuckle can also include a lock shelf that is configured to support the lock. The tapered lock engagement wall is perpendicular to the lock shelf.

Certain embodiments of the present disclosure provide a method of manufacturing a knuckle of a coupler of a rail vehicle. The method includes forming a leading beam having a pulling face; extending a lateral offset beam from the leading beam; extending a tail from the lateral offset beam; extending an extension wall from the lateral offset beam towards an end of the tail; and extending a tapered lock engagement wall from the extension wall to the end of the tail. Said extending the tapered lock engagement wall includes angling the tapered lock engagement wall in relation to the extension wall. The tapered lock engagement wall is configured to engage an interior face of a main body of a lock of the coupler. The interior face defines a knuckle-engaging surface that is configured to bear against the tapered lock engagement wall.

Certain embodiments of the present disclosure provide a coupler of a rail vehicle. The coupler includes a lock including a main body having an interior face defining a knuckle-engaging surface. The coupler also includes a knuckle including a leading beam having a pulling face, a lateral offset beam extending from the leading beam, a tail extending from the lateral offset beam, an extension wall extending from the lateral offset beam towards an end of the tail, and a tapered lock engagement wall extending from the extension wall to the end of the tail. The tapered lock engagement wall is angled in relation to the extension wall. The tapered lock engagement wall engages an interior face of a main body of a lock of the coupler. The knuckle-engaging surface bears against the tapered lock engagement wall.

DETAILED DESCRIPTION OF THE DISCLOSURE

Figure 1:
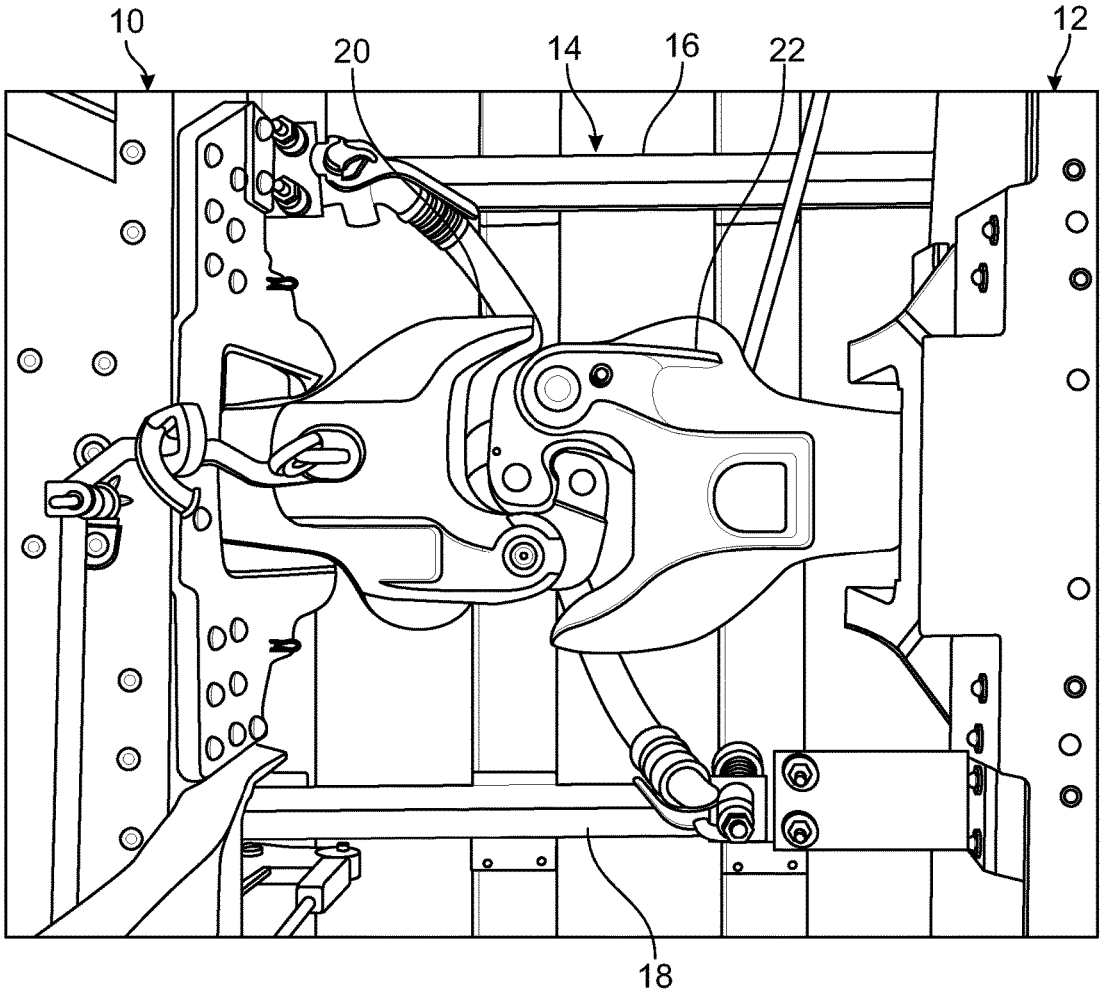
FIG. 1 illustrates a top view of a first rail car coupled to a second rail car.

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

The Association of American Railroads (AAR) adopted a fatigue-testing standard (AAR M-216) in 2009 and began enforcing the requirements in 2016. Before that time, concerns with knuckle life were primarily limited to wear on mating knuckle contact surfaces, as evident by use of gauges 25623-1 and 44057 in AAR Field Manual Rule 16 and gauges 47120-2, 49822, and 44250-3 in AAR Field Manual Rule 18. The new focus on fatigue life for the knuckles resulted in study of failure modes and fracture mechanics that had not previously occurred. Embodiments of the present disclosure address these issues, among others.

To achieve a distributed load across the knuckle and lock interface, one attempt at addressing these issues includes a vertically angled lock wall and lock. This configuration, however, presents issues. First, the knuckle typically must achieve tight tolerances necessary to maintain correct lock height above the tail of the knuckle. Thus, manufacture of such knuckles would involve added machining steps, thereby adding cost to the manufacturing process. Additionally, during the application of draft loads, the rear of the lock wall of the knuckle would act against the lock resulting in the same long reaction-force lever arm and elevated localized stress as current production knuckles. Further, a vertically tapered lock wall would involve both new knuckles and locks without the ability to interchange with standard production components.

Certain embodiments of the present disclosure provide a knuckle of a coupler of a rail vehicle. Certain embodiments of the present disclosure provide a railway freight car coupler knuckle that includes a tapered lock-engaging feature. The knuckle includes a lock wall having a lateral angle. The lock wall is configured to engage a lock of the coupler. The angled lock wall provides an improved transition in relation to a standard flat profile, thereby improving engagement at a lock interface.

In at least one embodiment, the angle of the angled lock wall is between 1 degree and 10 degrees. In at least one embodiment, the angle is at least 2 degrees. In at least one embodiment, the angle is 3 degrees.

It has been found that three degrees ensures full engagement with the lock, reduces a length of a moment arm between the knuckle and the lock, and minimizes or otherwise reduces a likelihood of fatigue, damage or failure of the knuckle. An overly acute angle may not move a load point forward from a rear point of the lock wall. For example, a knuckle angle of 3 degrees may be particularly suitable for ensuring even bearing across the knuckle and lock interface. Moreover, a transition point too far forward may create excess slack in the system. Further, a point too far back may result in point loading at the front of the knuckle lock wall and elevated localized stresses. It has been found that an angle of 3 degrees does not create excess slack in the system, while at the same time reducing stresses in the system.

Certain embodiments of the present disclosure provide a knuckle including a lock wall with a lateral taper, which ensures contact across an entire lock face during transmission of draft loads. The load distribution reduces stress through the tail of the knuckle in multiple ways. For example, elevated localized stress caused by point loading at the rear of the knuckle lock wall is no longer present. Additionally, lower lateral reaction forces, which are the product of the shorter reaction moment arm, reduce global stresses through the knuckle tail, especially at the root of the knuckle pulling lugs.

FIG. 1 illustrates a top view of a first rail car 10 coupled to a second rail car 12. The first rail car 10 and the second rail car 12 are configured to travel along a track 14 having rails 16 and 18. A coupler 20 of the first rail car 10 connects to a coupler 22 of the second rail car 12.

Figure 2:
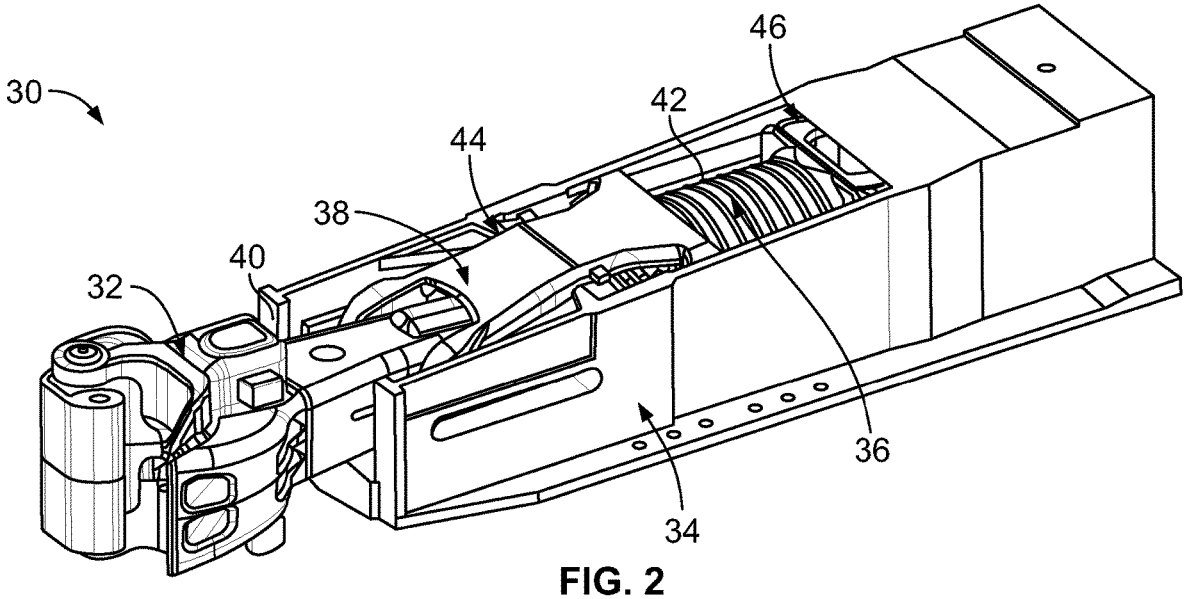
FIG. 2 illustrates a perspective top view of a car coupling system.

FIG. 2 illustrates a perspective top view of a car coupling system 30. The first rail car 10 and the second rail car 12 include a car coupling system 30. The car coupling system 30 includes a coupler 32 (such as the coupler 20 or the coupler 22 shown in FIG. 1), a draft sill 34, and a draft gear 36 with yoke 38. The coupler 32 is supported at a first end 40 by the draft sill 34 and at an opposite second end 42 by the draft gear 36 or cushion unit with the yoke 38. The draft gear 42 or cushion unit is constrained within the draft sill 34 by a pair of front stops 44 and a pair of rear stops 46.

Figure 3:
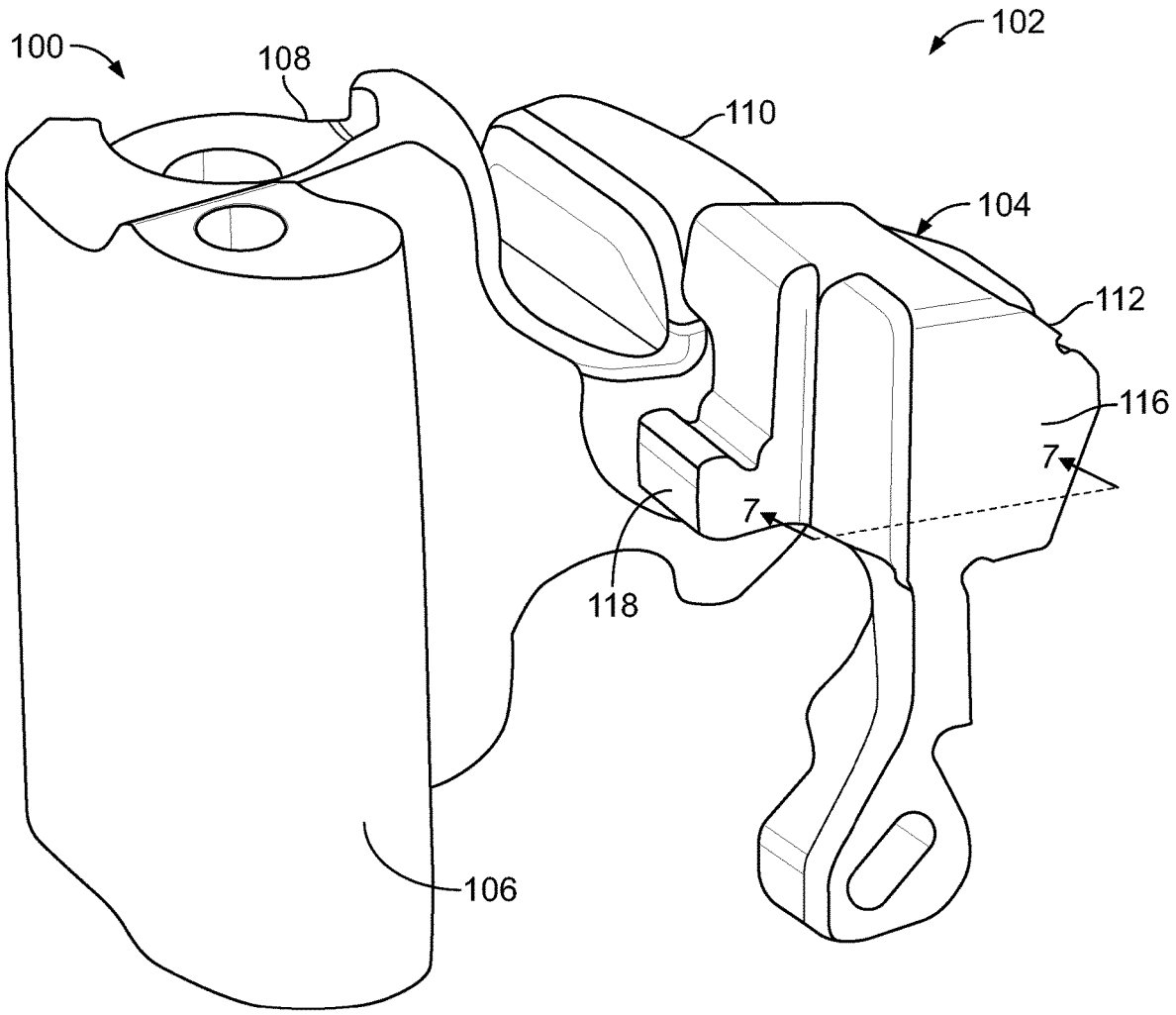
FIG. 3 illustrates a perspective lateral view of a knuckle of a coupler of rail vehicle, according to an embodiment of the present disclosure.

FIG. 3 illustrates a perspective lateral view of a knuckle 100 of a coupler 102 of rail vehicle, according to an embodiment of the present disclosure. The knuckle 100 engages a lock 104.

The knuckle 100 includes a leading beam 106 that connects to a lateral offset beam 108. The lateral offset beam 108 extends from the leading beam 106. A tail 110 extends from the lateral offset beam 108. For example, the tail 110 is a trailing portion of the lateral offset beam 108. The tail 110 engages the lock 104.

The lock 104 includes a main body 112 having an interior face (hidden from view in FIG. 3), an exterior face 116, and a nose 118 forwardly extending from the main body 112. At least a portion of the interior face contacts the tail 110 of the knuckle 100.

Figure 4:
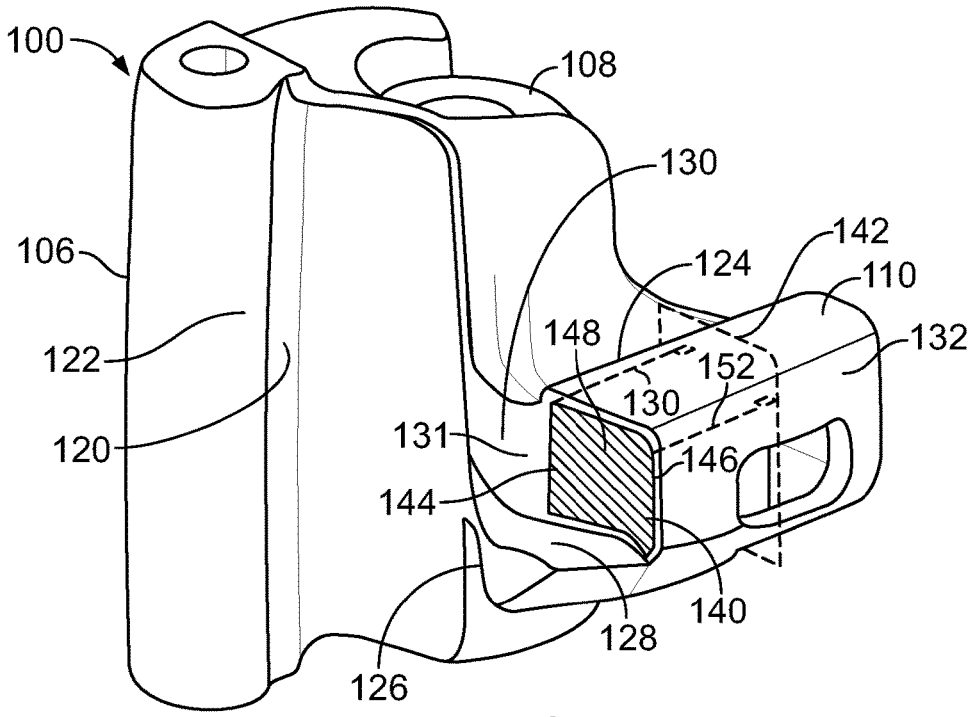
FIG. 4 illustrates a perspective lateral view of the knuckle, according to an embodiment of the present disclosure.

FIG. 4 illustrates a perspective lateral view of the knuckle 100, according to an embodiment of the present disclosure. The leading beam 106 includes a pulling face 120 at a rear surface 122. The tail 110 includes a top pulling lug 124, a bottom pulling lug 126, and a lock shelf 128 over the bottom pulling lug 126. An extension wall 130 extends from the lateral offset beam 108 towards an end 132 of the tail 110.

A tapered lock engagement wall 140 extends from the extension wall 130 to the end 132. Unlike conventional knuckles that have lock contact surfaces defined by a flat surface that is in the same plane as a lateral surface 131 of the extension wall 130, the tapered lock engagement wall 140 angles inwardly towards a central longitudinal plane 142 of the tail 110. For example, the tapered lock engagement wall 140 includes a front edge 144 that connects to a rear edge 146 through a flat surface 148. The front edge 144 is located a first perpendicular distance 150 from the central longitudinal plane 142, and the rear edge 146 is located a second perpendicular distance 152 from the central longitudinal plane 142. The first perpendicular distance 150 is greater than the second perpendicular distance 152. In this manner, the flat surface 148 recedes or tapers away from a plane of the lateral surface 131 of the extension wall 130. As such, the flat surface 148 of the tapered lock engagement wall 140 is out of plane in relation to the lateral surface 131 of the extension wall 130.

Figure 5:
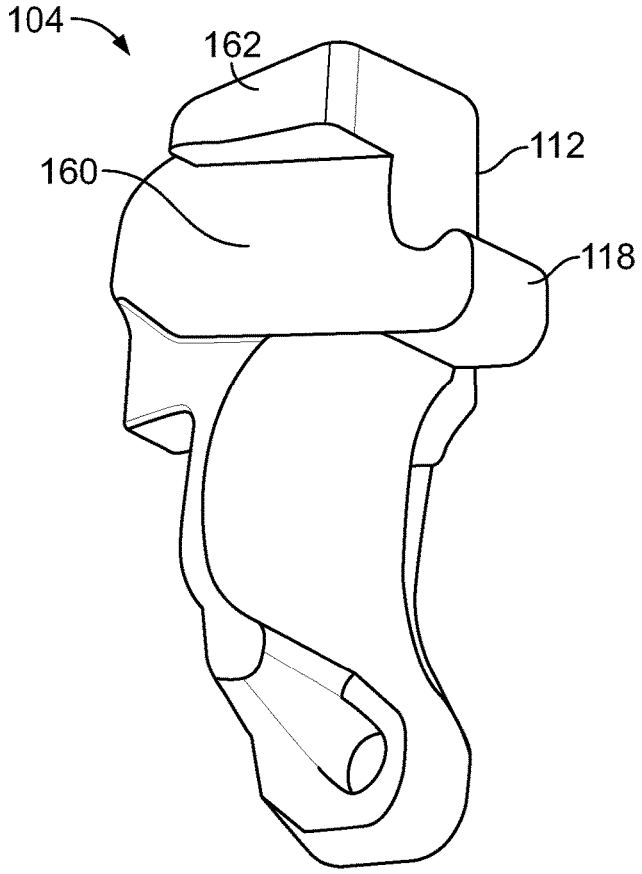
FIG. 5 illustrates a perspective interior lateral view of a lock, according to an embodiment of the present disclosure.

FIG. 5 illustrates a perspective interior lateral view of the lock 104, according to an embodiment of the present disclosure. The main body 112 includes the interior face 160. The interior face 160 defines a knuckle-engaging surface that is configured to bear or otherwise abut against the tapered lock engagement wall 140 (shown in FIG. 4) of the knuckle 100. The interior face 160 provides a flat surface. A top ledge 162 inwardly extends over and is laterally inward in relation to the interior face 160.

Figure 6:
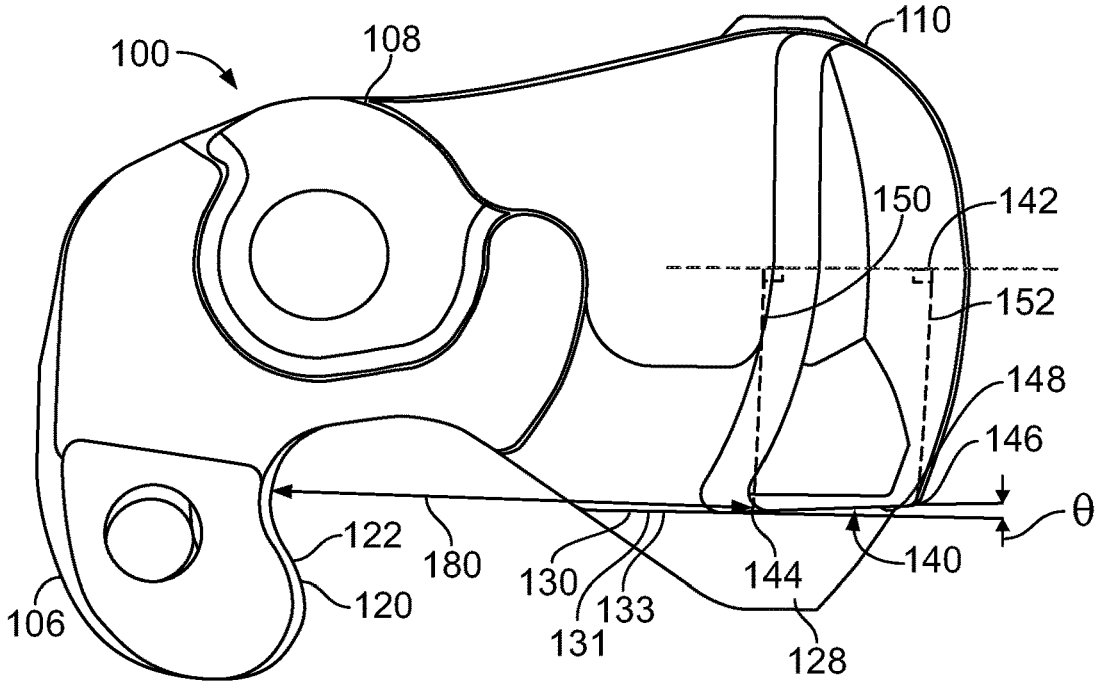
FIG. 6 illustrates a top view of the knuckle, according to an embodiment of the present disclosure.

FIG. 6 illustrates a top view of the knuckle 100, according to an embodiment of the present disclosure. As shown, the tapered lock engagement wall 140 angles inwardly towards the central longitudinal plane 142 of the tail 110. The flat surface 148 recedes or tapers away from the plane 133 of the lateral surface 131 of the extension wall 130. Accordingly, the flat surface 148 of the tapered lock engagement wall 140 is not within the plane 133.

The tapered lock engagement wall 140 is inwardly angled towards the central longitudinal plane 142 in relation to the lateral surface 131 of the extension wall 130 at an angle θ. The angle θ is not 180 degrees. As such, the tapered lock engagement wall 140 and the lateral surface 131 do not reside in a common plane. In at least one embodiment, the angle θ, which defines the inwardly tapered or recessed nature of the tapered lock engagement wall 140 is between 1 degree and 10 degrees. In at least one embodiment, the angle θ is at least 2 degrees. In at least one embodiment, the angle θ is 3 degrees. As noted above, it has been found that the angle θ of 3 degrees ensures full engagement with the lock, reduces a length of a moment arm between the knuckle and the lock, and minimizes or otherwise reduces a likelihood of fatigue, damage or failure of the knuckle. Further, the tapered lock engagement wall 140 shortens a length of the moment arm during pulling force from a distance between the rear edge 146 to the pulling face 120 to a shorter distance 180, which is between the front edge 144 and the pulling face 120.

Figure 7:
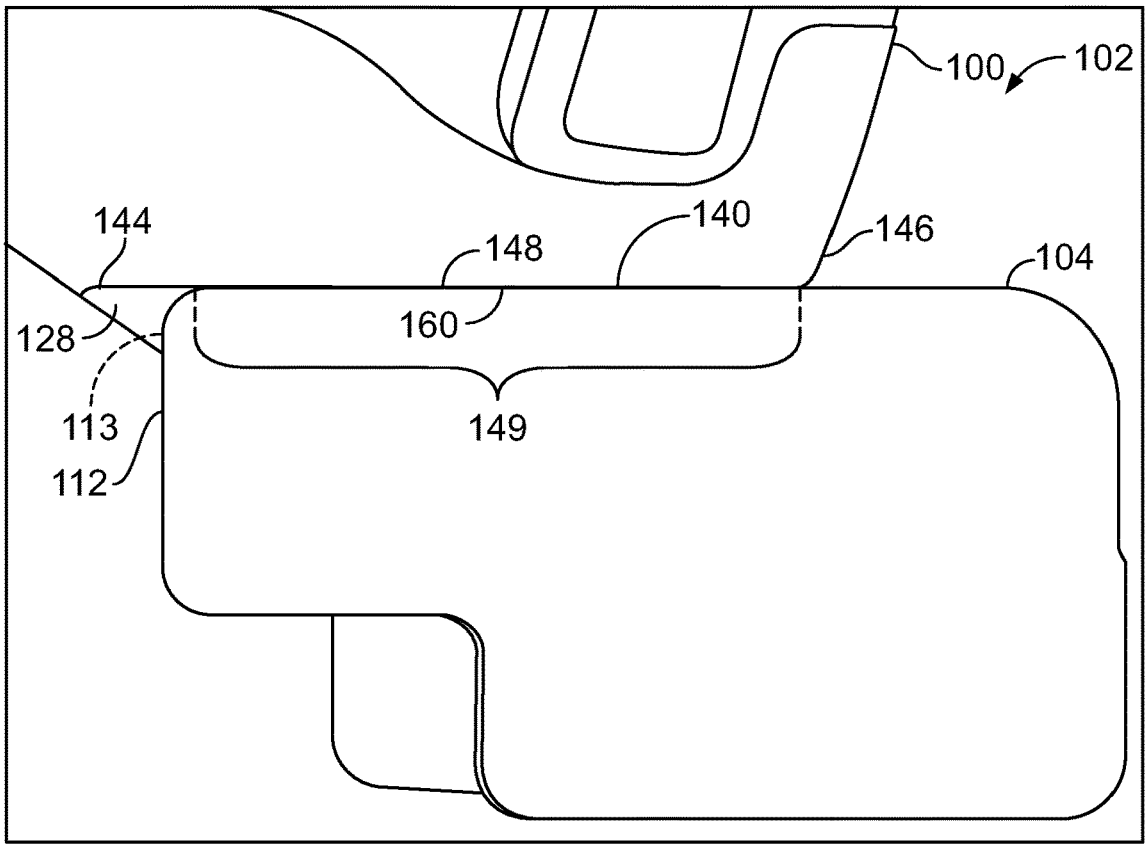
FIG. 7 illustrates a cross-sectional view of the lock engaging the knuckle during draft load application through line 7-7 of FIG. 2, according to an embodiment of the present disclosure.

FIG. 7 illustrates a cross-sectional view of the lock 104 engaging the knuckle 100 during draft load application through line 7-7 of FIG. 2, according to an embodiment of the present disclosure. A bottom surface 113 of the main body 112 of the lock 104 is supported on the lock shelf 128 of the knuckle 100. Referring to FIGS. 3-7, during draft load application, the interior face 160 of the lock 104 bears or otherwise abuts against the tapered lock engagement wall 140 of the knuckle 100 at an engagement interface 149. In at least one embodiment, the tapered lock engagement wall 140 is perpendicular to the lock shelf 128. For example, the tapered lock engagement wall 140 may be vertically oriented (for example, residing in an upright, vertical plane), while the lock shelf 128 may be horizontally oriented (for example, residing in a horizontal plane that is orthogonal to the vertical plane).

The angled nature of the tapered lock engagement wall 140 relative to the extension wall 130 provides the engagement interface 149 with the interior face 160 of the lock 104 during draft load application. The engagement interface 149 is a bearing interface that is full, flat, and even between the tapered lock engagement wall 140 and the interior face 160. The forces between the tapered lock engagement wall 140 and the interior face 160 of the lock 104 are distributed and dispersed over and along the engagement wall 140, in contrast to conventional knuckles, in which the forces are concentrated at a single point, such as at a rear edge of a tail. In at least one embodiment, the tapered lock engagement wall 140 is configured to bear against an entirety of the interior face 160 of the lock 104 during draft load application, thereby dispersing forces along the engagement interface 149, instead of at a point. Alternatively, the tapered lock engagement wall 140 may be configured to bear against less than an entirety of the interior face 160 during draft load application.

During draft load application on the pulling face 120 of the knuckle 100, the top pulling lug 124 and the bottom pulling lug 126 of the knuckle 100 engage with the coupler body. The offset of the pulling face 120 relative to the top pulling lug 124 and the bottom pulling lug 126 (due to the lateral offset beam 108) causes rotation and a lateral reaction against the interior face 160 of the lock 104 during loading. The reactionary forces against the tapered lock engagement wall 140 are decreased (in comparison with conventional knuckles) because of the shorter reaction or moment arm defined by the distance 180, and the load is distributed across the entire engagement interface 149, which reduces localized stress.

Embodiments of the present disclosure provide knuckles 100 that can be used with a variety of freight car coupler assemblies. The knuckles 100 may also be interchangeable with current standard AAR freight knuckles. The benefits of the knuckles 100 are realized during typical loading and operation of the freight coupler.

As shown and described, the knuckle 100 includes the tapered lock engagement wall 140 which forms the engagement interface 149 with the interior face 160 of the lock 104 during loading. In at least one other embodiment, the interior face 160 may be angled. For example, a portion of the interior face 160 may be angled in relation to another portion of the interior face 160. In this manner, the interior face 160 having an angle may provide the engagement interface 149 with the knuckle 100 during loading, whether or not the knuckle 100 includes the tapered lock engagement wall 140.

Figure 8:
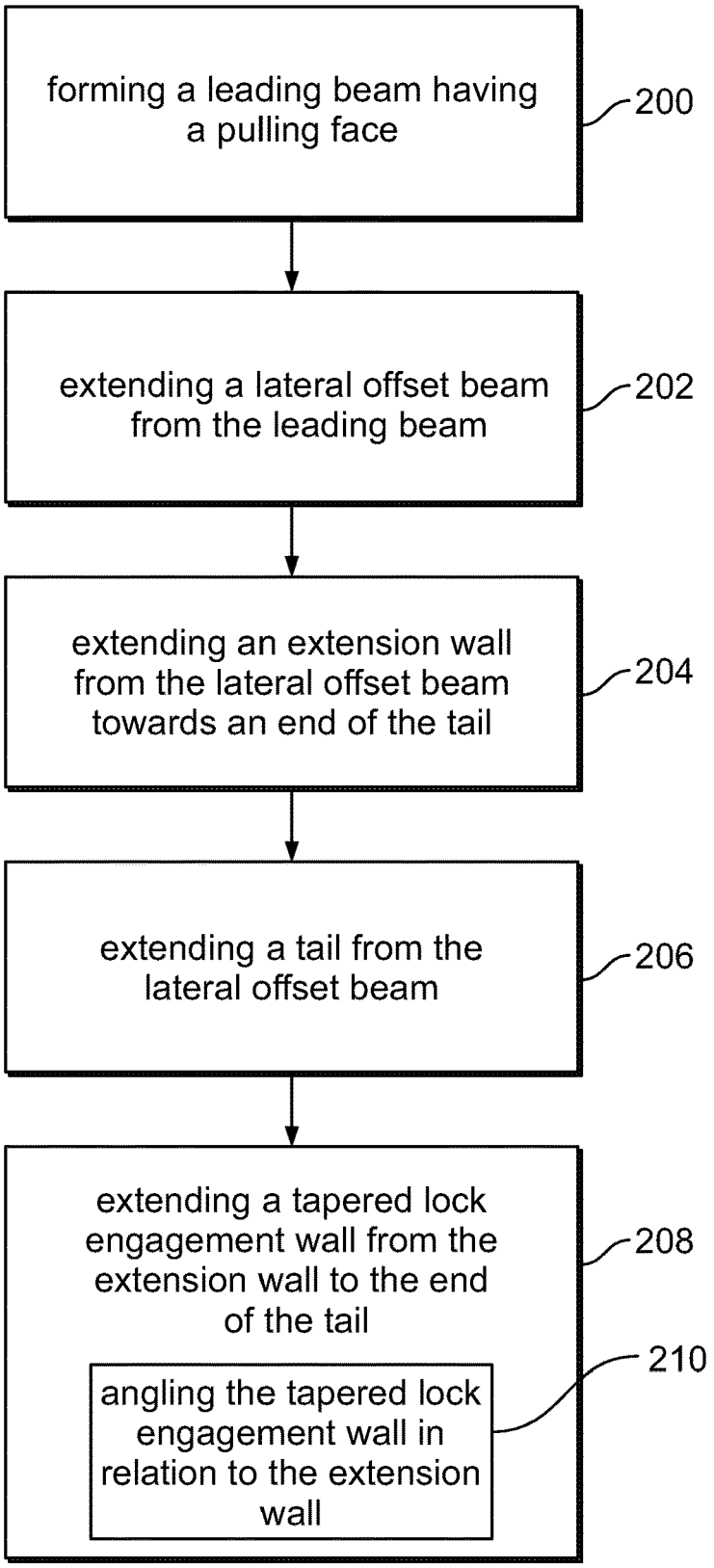
FIG. 8 illustrates a flow chart of a method of manufacturing a knuckle of a coupler of a rail vehicle, according to an embodiment of the present disclosure.

FIG. 8 illustrates a flow chart of a method of manufacturing a knuckle of a coupler of a rail vehicle, according to an embodiment of the present disclosure. The method includes forming (200) a leading beam having a pulling face; extending (202) a lateral offset beam from the leading beam; extending (204) a tail from the lateral offset beam; extending (206) an extension wall from the lateral offset beam towards an end of the tail; and extending (208) a tapered lock engagement wall from the extension wall to the end of the tail, wherein said extending (208) the tapered lock engagement wall includes angling (210) the tapered lock engagement wall in relation to the extension wall. In at least one embodiment, the knuckle is integrally molded and formed as a single piece. For example, a mold may be used to provide the forming and extending steps. In at least one other embodiment, the various portions of the knuckle may be separately affixed to one another.

The tapered lock engagement wall is configured to engage an interior face of a main body of a lock of the coupler. The interior face defines a knuckle-engaging surface that is configured to bear against the tapered lock engagement wall.

As described herein, embodiments of the present disclosure provide a knuckle of a coupler of a rail vehicle that is less susceptible to fatigue, damage, or failure. Moreover, embodiments of the present disclosure provide a knuckle that is cost-effective to manufacture.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

The invention claimed is:

1. A knuckle of a coupler of a rail vehicle, the knuckle comprising:

a leading beam having a pulling face;

a lateral offset beam extending from the leading beam;

a tail extending from the lateral offset beam;

an extension wall extending from the lateral offset beam towards an end of the tail; and a tapered lock engagement wall extending from the extension wall to the end of the tail, the tapered lock engagement wall being angled in relation to the extension wall, wherein the tapered lock engagement wall is configured to engage an interior face of a main body of a lock of the coupler, wherein the interior face defines a knuckle-engaging surface that is configured to bear against the tapered lock engagement wall.

2. The knuckle of claim 1, wherein the tapered lock engagement wall angles inwardly towards a central longitudinal plane of the tail.

3. The knuckle of claim 1, wherein the tapered lock engagement wall comprises a front edge that connects to a rear edge through a flat surface, wherein the rear edge is closer to a central longitudinal plane of the tail than the front edge.

4. The knuckle of claim 1, wherein the tapered lock engagement wall is out of plane in relation to a lateral surface of the extension wall.

5. The knuckle of claim 1, wherein the tapered lock engagement wall is at an angle θ in relation to a lateral surface of the extension wall, wherein the angle θ is not 180 degrees.

6. The knuckle of claim 5, wherein the angle θ is between 1 degree and 10 degrees.

7. The knuckle of claim 5, wherein the angle θ is at least 2 degrees.

8. The knuckle of claim 5, wherein the angle θ is 3 degrees.

9. The knuckle of claim 1, wherein the tapered lock engagement wall is configured to bear against an entirety of the interior face of the lock during draft load application.

10. The knuckle of claim 1, further comprising a lock shelf that is configured to support the lock, wherein the tapered lock engagement wall is perpendicular to the lock shelf.

11. A method of manufacturing a knuckle of a coupler of a rail vehicle, the method comprising:

forming a leading beam having a pulling face;

extending a lateral offset beam from the leading beam;

extending a tail from the lateral offset beam;

extending an extension wall from the lateral offset beam towards an end of the tail; and extending a tapered lock engagement wall from the extension wall to the end of the tail, wherein said extending the tapered lock engagement wall comprises angling the tapered lock engagement wall in relation to the extension wall, wherein the tapered lock engagement wall is configured to engage an interior face of a main body of a lock of the coupler, wherein the interior face defines a knuckle-engaging surface that is configured to bear against the tapered lock engagement wall.

12. A coupler of a rail vehicle, the coupler comprising:

a lock including a main body having an interior face defining a knuckle-engaging surface; and a knuckle comprising:

a leading beam having a pulling face;

a lateral offset beam extending from the leading beam;

a tail extending from the lateral offset beam;

an extension wall extending from the lateral offset beam towards an end of the tail; and a tapered lock engagement wall extending from the extension wall to the end of the tail, the tapered lock engagement wall being angled in relation to the extension wall, wherein the tapered lock engagement wall engages an interior face of a main body of a lock of the coupler, and wherein the knuckle-engaging surface bears against the tapered lock engagement wall.

13. The coupler of claim 12, wherein the tapered lock engagement wall angles inwardly towards a central longitudinal plane of the tail.

14. The coupler of claim 12, wherein the tapered lock engagement wall comprises a front edge that connects to a rear edge through a flat surface, wherein the rear edge is closer to a central longitudinal plane of the tail than the front edge.

15. The coupler of claim 12, wherein the tapered lock engagement wall is out of plane in relation to a lateral surface of the extension wall.

16. The coupler of claim 12, wherein the tapered lock engagement wall is at an angle θ in relation to a lateral surface of the extension wall, wherein the angle θ is not 180 degrees.

17. The coupler of claim 16, wherein the angle θ is between 1 degree and 10 degrees.

18. The coupler of claim 16, wherein the angle θ is 3 degrees.

19. The coupler of claim 12, wherein the tapered lock engagement wall bears against an entirety of the interior face of the lock during draft load application.

20. The coupler of claim 12, further comprising a lock shelf that supports the lock, wherein the tapered lock engagement wall is perpendicular to the lock shelf.

* * * * *